US011299317B2

(12) United States Patent
Sill et al.

(10) Patent No.: US 11,299,317 B2
(45) Date of Patent: Apr. 12, 2022

(54) CARTON WITH TAB

(71) Applicant: Inno-Pak, LLC, Delaware, OH (US)

(72) Inventors: Jonathan D. Sill, Delaware, OH (US); Steven A. Mayer, Indianapolis, IN (US)

(73) Assignee: Inno-Pak, LLC, Delaware, OH (US)

( * ) Notice: Subject to any disclaimer, the term of this patent is extended or adjusted under 35 U.S.C. 154(b) by 0 days.

(21) Appl. No.: 16/161,806

(22) Filed: Oct. 16, 2018

(65) Prior Publication Data

US 2019/0144157 A1 May 16, 2019

Related U.S. Application Data

(60) Provisional application No. 62/585,797, filed on Nov. 14, 2017.

(51) Int. Cl.

| | |
|---|---|
| ***B65D 5/66*** | (2006.01) |
| ***B65D 71/12*** | (2006.01) |
| ***B65D 5/42*** | (2006.01) |

(52) U.S. Cl.

CPC ..... *B65D 5/6655* (2013.01); *B65D 5/4204* (2013.01); *B65D 5/4216* (2013.01); *B65D 71/125* (2013.01); *B65D 2571/0066* (2013.01); *B65D 2571/00141* (2013.01); *B65D 2571/00277* (2013.01); *B65D 2571/00981* (2013.01)

(58) Field of Classification Search

CPC .. B65D 5/6655; B65D 5/4204; B65D 5/4216; B65D 71/125; B65D 2571/00141; B65D 2571/00277; B65D 2571/006; B65D 2571/00981

USPC ..... 206/551, 776, 781–783; 229/162.1, 229/162.4, 162.7

See application file for complete search history.

(56) References Cited

U.S. PATENT DOCUMENTS

| | | | | |
|---|---|---|---|---|
| 2,700,456 | A * | 1/1955 | Gillam | B65D 5/5038 206/777 |
| 2,948,390 | A * | 8/1960 | Wagaman | B65D 5/4204 229/162.7 |
| 3,071,882 | A * | 1/1963 | Eisman | G09F 3/00 40/312 |
| 3,144,191 | A * | 8/1964 | Saidel | B65D 5/02 229/212 |
| 3,155,273 | A * | 11/1964 | Cote | B65D 5/16 221/63 |
| 3,176,899 | A * | 4/1965 | McMahon | B65D 85/32 206/521.1 |
| 3,205,603 | A * | 9/1965 | Frankk | B65D 5/4229 206/459.1 |
| 3,368,733 | A * | 2/1968 | Wainberg | B65D 5/4204 229/194 |
| D259,253 | S | 5/1981 | Nelson | |

(Continued)

*Primary Examiner* — Chun Hoi Cheung
(74) *Attorney, Agent, or Firm* — Ward and Smith, P.A.; Ryan K. Simmons

(57) ABSTRACT

A foldable food carton including a lid portion; a bottom portion; and a viewable tab attached to the lid portion, wherein the tab comprises one or more of alphabetic text, numeric text, QR code, bar code, graphic, design, or combination thereof printed on the tab. A method of assembling a carton with a viewable tab, including providing a carton in an unfolded configuration, and folding the carton into an assembled configuration, wherein upon folding the carton into the assembled configuration the tab moves from a first position to a second position.

18 Claims, 9 Drawing Sheets

(56) References Cited

U.S. PATENT DOCUMENTS

D262,945 S 2/1982 Lytra
D263,796 S 4/1982 Fireman
D265,551 S 7/1982 Colby
D271,283 S 11/1983 Taylor
D271,664 S 12/1983 Cowan, Jr
4,441,614 A * 4/1984 Gulliver ..... B65D 5/4204 229/123
D274,407 S 6/1984 Rosenburg, Jr.
D279,355 S 6/1985 Ujiie
4,630,733 A * 12/1986 Fear ..... B65D 5/4229 206/459.1
D291,065 S 7/1987 Pugh
D295,958 S 5/1988 Pugh
D295,959 S 5/1988 Pugh
D300,906 S 5/1989 Caldwell
D302,948 S 8/1989 Blum
D304,907 S 12/1989 Tamsen
D305,204 S 12/1989 Reifein
4,911,298 A 3/1990 Miyagawa et al.
D308,941 S 7/1990 Kong
D309,262 S 7/1990 Coiner
D309,753 S 8/1990 Kagelmann-Holtz
D326,225 S 5/1992 Beckerman
5,114,002 A 5/1992 Warner
D332,347 S 1/1993 Raadt et al.
D332,744 S 1/1993 McCooey
D333,781 S 3/1993 Kobel
D335,820 S 5/1993 Detert
D337,047 S 7/1993 Pearce
D351,554 S 10/1994 Kim
D362,405 S 9/1995 Dallimore
D365,755 S 1/1996 Kanfer et al.
5,505,372 A 4/1996 Edson et al.
D371,070 S 6/1996 Brier
D371,959 S 7/1996 Hupp
D372,401 S 8/1996 Lillelund et al.
D378,126 S 2/1997 Williams
D380,964 S 7/1997 Miller
D383,669 S 9/1997 Taylor
D386,079 S 11/1997 Harper
5,690,273 A * 11/1997 Jensen ..... A47G 21/001 229/107
D387,979 S 12/1997 Dolan
D389,739 S 1/1998 Auclair
D401,147 S 11/1998 Miller
D403,576 S 1/1999 Weiss
D406,754 S 3/1999 Tanabe
D415,960 S 11/1999 Majdanski et al.
5,992,733 A 11/1999 Gomes
6,041,997 A * 3/2000 Jensen ..... B65D 5/4229 206/459.5
D425,702 S 5/2000 Baich
D429,462 S 8/2000 Kumakura et al.
D429,635 S 8/2000 Ito et al.
D430,017 S 8/2000 Ito
D430,396 S 9/2000 Biesecker
D433,260 S 11/2000 Shimbo
D440,491 S 4/2001 Stacy-ryan
D442,859 S 5/2001 Hirschey
6,227,367 B1 5/2001 Harrelson et al.
D443,204 S 6/2001 Garrant et al.
D464,878 S 10/2002 Thompson
D469,349 S 1/2003 Meeker et al.
D469,692 S 2/2003 Meeker et al.
D485,172 S 1/2004 Defino, Jr.
6,681,983 B2 * 1/2004 Bill-Moore ..... B65D 5/4204 206/459.1
D518,371 S 4/2006 Franic
D519,366 S 4/2006 Epstein
D527,629 S 9/2006 Franic
D529,795 S 10/2006 Kragtwijk
D536,245 S 2/2007 Bruun
D536,612 S 2/2007 Guerts et al.
D540,164 S 4/2007 Franic
D556,599 S 12/2007 Keener
D570,683 S 6/2008 Kortsmit et al.
D578,883 S 10/2008 Kisch
D580,751 S 11/2008 Blick
7,444,956 B2 11/2008 Vadis
D582,791 S 12/2008 Elmerhaus
D587,998 S 3/2009 Kaisanlahti et al.
D593,211 S 5/2009 Dewitt
D595,104 S 6/2009 Goodrich
D596,027 S 7/2009 Kalberer
D601,016 S 9/2009 Kalberer
D602,353 S 10/2009 Anderson et al.
D605,506 S 12/2009 Franic
D607,987 S 1/2010 Paxton et al.
D616,739 S 6/2010 Kalberer
D617,636 S 6/2010 Vanhoutte
D618,543 S 6/2010 Polaski et al.
7,780,004 B2 8/2010 Carlozzi et al.
D623,939 S 9/2010 Tearle
D624,405 S 9/2010 Franic
D626,831 S 11/2010 Nicholas
D629,294 S 12/2010 Chinnis
D629,295 S 12/2010 Franic
D636,662 S 4/2011 Ignacio et al.
D637,078 S 5/2011 Peng
D637,488 S 5/2011 Franic
D638,702 S 5/2011 Lowery et al.
D644,099 S 8/2011 Martinez Rodriguez
8,006,893 B2 * 8/2011 Burke ..... B65D 5/4229 229/146
D644,508 S 9/2011 Martinez Rodriguez
D646,964 S 10/2011 Ampadu et al.
D647,398 S 10/2011 Winkler
D649,067 S 11/2011 Birdwell et al.
D649,451 S 11/2011 Franic
8,056,799 B2 * 11/2011 Burke ..... B65D 5/667 206/459.5
8,066,178 B2 * 11/2011 Sorrentino ..... B65D 5/0227 206/769
D649,886 S 12/2011 Ocampo
D651,074 S 12/2011 Lacey
D655,153 S 3/2012 Mitten et al.
D668,540 S 10/2012 Lutzig
D675,092 S 1/2013 Sill
8,356,743 B2 1/2013 Spivey, Sr.
D675,920 S 2/2013 Sill
8,376,214 B2 2/2013 Spivey et al.
D678,779 S 3/2013 Lee
D679,950 S 4/2013 Cooper
D681,444 S 5/2013 Oja et al.
D685,633 S 7/2013 Thomas
D688,568 S 8/2013 Noel
D693,215 S 11/2013 Sill
D693,217 S 11/2013 Sill
D693,218 S 11/2013 Sill
D695,104 S 12/2013 Sill
D696,725 S 12/2013 Sasken-Duff et al.
8,607,987 B2 12/2013 Oja et al.
D699,103 S 2/2014 Rathbone et al.
D706,132 S 6/2014 Sill
D708,511 S 7/2014 Green
D710,713 S 8/2014 Fath
D712,275 S 9/2014 Irek
D713,716 S 9/2014 Oja et al.
D716,649 S 11/2014 McAdam
D717,162 S 11/2014 Baker
D717,163 S 11/2014 Paulsen
D717,645 S 11/2014 Wilmers
D719,440 S 12/2014 Matloff
D719,845 S 12/2014 Lee
D722,869 S 2/2015 Himmelsbach et al.
D726,004 S 4/2015 Chiang
D727,732 S 4/2015 Petty
D728,357 S 5/2015 Pierce, Jr. et al.
D729,055 S 5/2015 Lemnios et al.
D729,058 S 5/2015 Ishikawa
D734,145 S 7/2015 Fath et al.
D739,228 S 9/2015 Jondal et al.
D740,654 S 10/2015 Boehnen

(56) References Cited

U.S. PATENT DOCUMENTS

| | | | | |
|---|---|---|---|---|
| D743,248 | S | | 11/2015 | Fath et al. |
| D746,673 | S | | 1/2016 | Sanfilippo et al. |
| D746,699 | S | | 1/2016 | Fath |
| D746,700 | S | | 1/2016 | Boehnen et al. |
| D753,919 | S | | 4/2016 | Parker |
| D760,598 | S | | 7/2016 | White et al. |
| D762,113 | S | | 7/2016 | Mayer |
| D762,465 | S | | 8/2016 | Popper et al. |
| D766,108 | S | | 9/2016 | Brown et al. |
| D774,891 | S | | 12/2016 | Mayer et al. |
| D774,893 | S | | 12/2016 | Mayer |
| D774,895 | S | | 12/2016 | Mayer et al. |
| D774,896 | S | | 12/2016 | Mayer |
| D774,897 | S | | 12/2016 | Mayer et al. |
| D774,898 | S | | 12/2016 | Mayer |
| D776,522 | S | | 1/2017 | Mayer |
| D784,164 | S | | 4/2017 | Toth |
| D787,313 | S | | 5/2017 | Mayer et al. |
| D787,314 | S | | 5/2017 | Sill |
| D787,315 | S | | 5/2017 | Sill |
| D787,316 | S | | 5/2017 | Sill |
| D787,929 | S | | 5/2017 | Sill |
| D787,933 | S | | 5/2017 | Sill |
| D789,783 | S | | 6/2017 | DeBusk |
| D795,696 | S | | 8/2017 | Pitera et al. |
| D799,317 | S | | 10/2017 | Sill et al. |
| D799,955 | S | | 10/2017 | Sill |
| D800,546 | S | | 10/2017 | Sill et al. |
| D800,547 | S | | 10/2017 | Sill et al. |
| D800,548 | S | | 10/2017 | Sill |
| D804,298 | S | | 12/2017 | Demmink |
| D809,917 | S | | 2/2018 | Wieser |
| D816,479 | S | | 5/2018 | Sill et al. |
| D816,480 | S | | 5/2018 | Sill |
| D816,481 | S | | 5/2018 | Sill |
| D820,688 | S | | 6/2018 | Fath |
| D822,283 | S | | 7/2018 | Gaito |
| D822,480 | S | | 7/2018 | Rivera |
| D829,095 | S | | 9/2018 | Mckenna et al. |
| D839,725 | S | | 2/2019 | Ralston et al. |
| D840,219 | S | | 2/2019 | Mckenna et al. |
| D840,807 | S | | 2/2019 | Ross |
| D842,098 | S | | 3/2019 | Ross |
| D844,430 | S | | 4/2019 | Dammers et al. |
| D846,378 | S | | 4/2019 | Sill et al. |
| D846,379 | S | | 4/2019 | Sill |
| D846,981 | S | | 4/2019 | Sill |
| D846,982 | S | | 4/2019 | Horne |
| D847,454 | S | | 4/2019 | Mathia |
| D847,626 | S | | 5/2019 | Sill |
| D852,032 | S | | 6/2019 | Horne |
| D854,925 | S | | 7/2019 | Fath |
| D855,453 | S | * | 8/2019 | Meyer ..... D9/418 |
| D856,131 | S | | 8/2019 | Hon |
| D856,794 | S | | 8/2019 | Sill |
| D856,795 | S | | 8/2019 | Sill |
| D856,796 | S | | 8/2019 | Sill |
| D856,797 | S | | 8/2019 | Sill |
| D865,517 | S | | 11/2019 | Gressel et al. |
| D866,314 | S | | 11/2019 | Marotti |
| D867,125 | S | | 11/2019 | Sill et al. |
| D879,603 | S | | 3/2020 | Sill |
| D879,604 | S | | 3/2020 | Sill et al. |
| D880,999 | S | | 4/2020 | Sill |
| D881,000 | S | | 4/2020 | Sill et al. |
| D881,001 | S | | 4/2020 | Sill et al. |
| D881,002 | S | | 4/2020 | Sill et al. |
| D906,100 | S | | 12/2020 | Sill et al. |
| 2009/0236351 | A1 | | 9/2009 | Chu et al. |
| 2010/0059579 | A1 | | 3/2010 | House |
| 2013/0220873 | A1 | | 8/2013 | Holley, Jr. |
| 2014/0103100 | A1 | | 4/2014 | Falcon et al. |
| 2015/0344216 | A1 | | 12/2015 | Petty et al. |
| 2016/0009442 | A1 | | 1/2016 | Block et al. |
| 2016/0362220 | A1 | | 12/2016 | Kearns |
| 2017/0066586 | A1 | | 3/2017 | Petty et al. |
| 2018/0009585 | A1 | | 1/2018 | Ramsuer et al. |
| 2018/0022500 | A1 | | 1/2018 | Zhu |
| 2018/0118403 | A1 | | 5/2018 | Petty et al. |
| 2018/0127141 | A1 | | 5/2018 | Brundage et al. |
| 2018/0141734 | A1 | | 5/2018 | Kooc et al. |
| 2018/0297761 | A1 | | 10/2018 | Alexander et al. |
| 2018/0319560 | A1 | | 11/2018 | Blin et al. |
| 2019/0009946 | A1 | | 1/2019 | Nixon et al. |
| 2019/0016501 | A1 | | 1/2019 | Djokovic et al. |
| 2019/0144157 | A1 | | 5/2019 | Sill et al. |

* cited by examiner

CARTON WITH TAB

RELATED APPLICATIONS

This application claims priority to and incorporates herein by reference related U.S. Provisional Patent Application No. 62/585,797 filed on Nov. 14, 2017.

TECHNICAL FIELD

The presently disclosed subject matter relates generally to a carton, and more particularly to a foldable carton with a viewable tab.

BACKGROUND

In the grocery and foodservice industry, it is often desired to include messages, such as promotional messages, on food product packaging. For example, a bakery/deli department may desire to promote a product, such as a pie or other bakery/deli item as "Fresh Today" or having a promotional associated with the item, such as being on sale or having a coupon attached. Normally, these promotional messages are printed on a label, such as an adhesive label, and then placed on the top of the product's package. However, a number of bakery/deli items are packaged in cartons having a window built in to it so the consumer can see the bakery/deli item packaged inside. In these type of windowed cartons, the promotional message labels are often placed on the window portion, thus blocking the consumer's view of the product.

Further, printing messages, such as promotional messages, directly on the package itself has its own challenges, such as being difficult to see by the consumer (does not stand out) and finding adequate space on the front side of the package for additional printing. Techniques, such as printing on the back side of the packaging material has drawbacks, because such printing would normally only be visible to the consumer after they purchased the item and opened the package, and before even seeing the promotional message.

What is needed is a way to improve visibility of product messages, such as promotional messages, which allows for the product message to stand out and be more visible to the consumer so they can see exactly what the message is, while not blocking the view of the product contained inside.

SUMMARY

In one embodiment, a carton with a viewable tab is provided. The carton may include a lid portion; a bottom portion; and a viewable tab attached to the lid portion, wherein the tab may include one or more of alphabetic text, numeric text, QR code, bar code, graphic, design, or combination thereof printed on the tab. The lid portion may be hingeably connected to the bottom portion. The tab may be configurable to extend vertically up relative to a top surface of the lid portion. The tab may be movable between a first position and a second position. In the first position the tab may be orientated substantially flat against the top surface of the lid portion and in the second position the tab may be orientated substantially perpendicular to the top surface of the lid portion. The tab may be manually movable from the first position to the second position. The tab may be automatically movable from the first position to the second position as a result of at least one of folding the carton to an assembled state or closing the lid portion. The tab may be removable from the carton. The interface between the tab and where it attaches to the lid portion may be weakened.

The interface between the tab and where it attaches to the lid portion may include a score line or perforations. The tab may be attached at an interface between a top surface and a side portion of the lid portion. The carton may further include a window disposed in the lid portion. The window may be disposed in the top surface of the lid portion. The window may be disposed in the top surface of the lid portion and may extend into one or more of a front side or a rear side of the lid portion. The tab may attach to the lid portion at a peripheral edge of the window. The tab may attach to the lid portion at a peripheral edge of the window that extends into one or more of the front side or the rear side of the lid portion. The tab may extend vertically up from its attachment point at the peripheral edge of the window to height substantially equal to the top surface of the lid portion.

In another embodiment, a method of assembling a carton with a viewable tab is provided. The method may include providing a carton in an unfolded configuration, the carton may include a lid portion; a bottom portion; and a tab attached to an interface between a top surface of the lid portion and a side of the lid portion; and folding the carton into an assembled configuration, wherein upon folding the carton into the assembled configuration the tab moves from a first position to a second position. In the first position the tab may be orientated substantially flat against the top surface of the lid portion and in the second position the tab may be orientated substantially perpendicular to the top surface of the lid portion. The carton further may include a window disposed in the lid portion. The tab may attach at its bottom edge to the interface between a rear edge of the top surface of the lid portion and a top edge of a rear side of the lid portion. The tab may be removable. The tab may include one or more of alphabetic text, numeric text, QR code, bar code, graphic, design, or combination thereof printed on the tab.

Certain aspects of the subject matter of the invention having been stated hereinabove, which are addressed in whole or in part by the disclosed subject matter, other aspects will become evident as the description proceeds when taken in connection with the accompanying Examples and Drawings as best described herein below

BRIEF DESCRIPTION OF THE DRAWINGS

Figure 1:
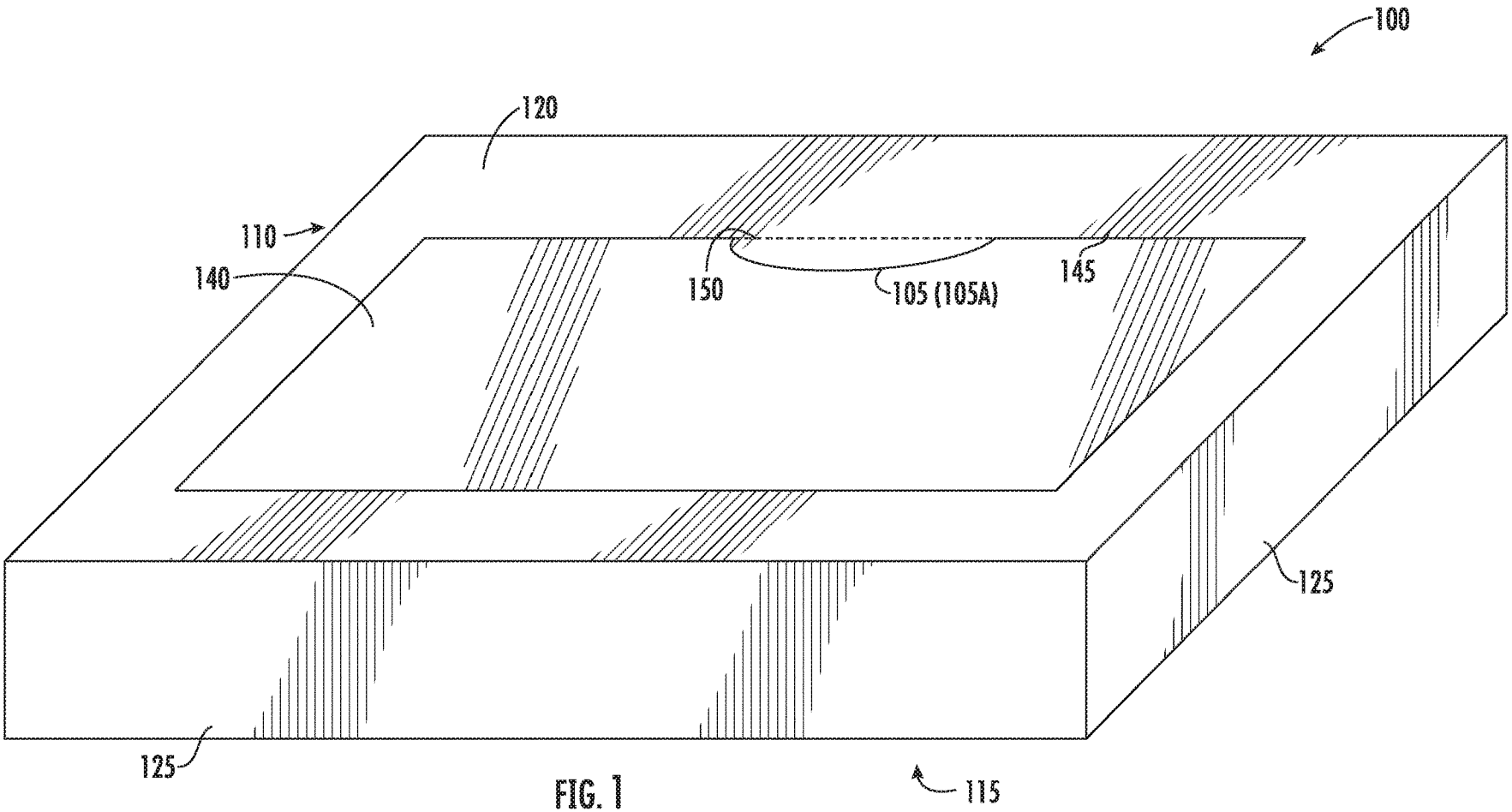
Figure 2:
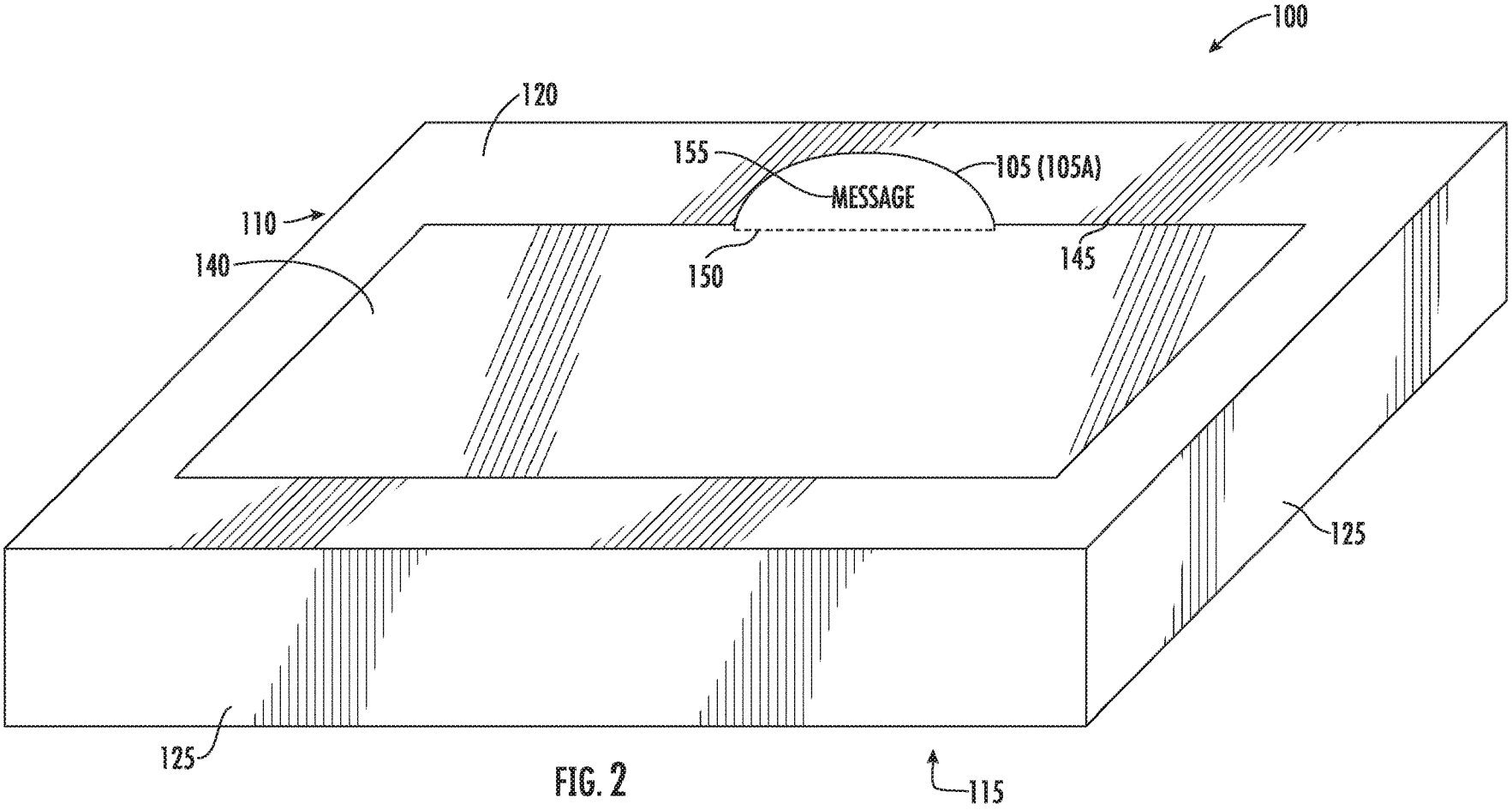
Figure 3:
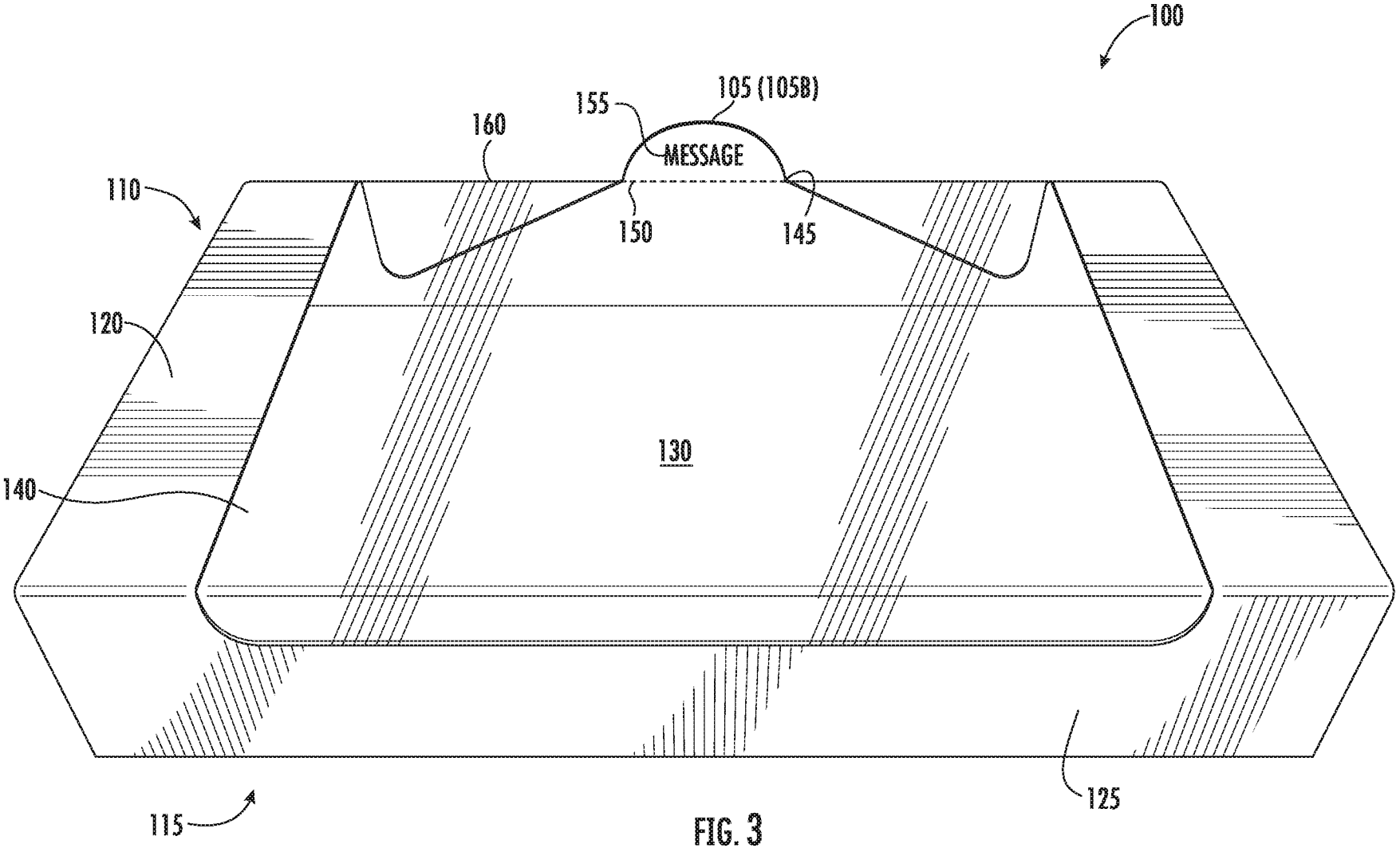
Figure 4:
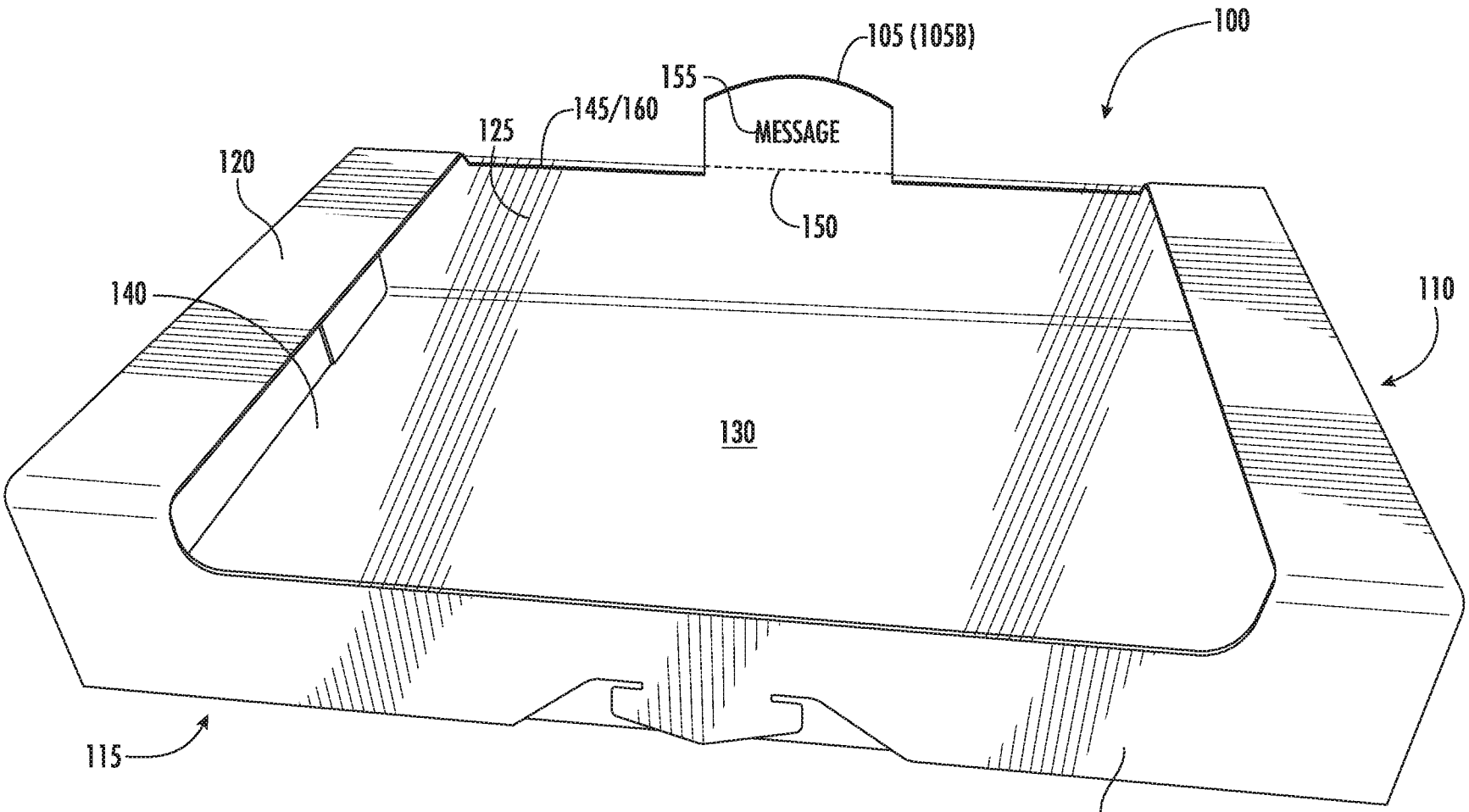
Figure 5:
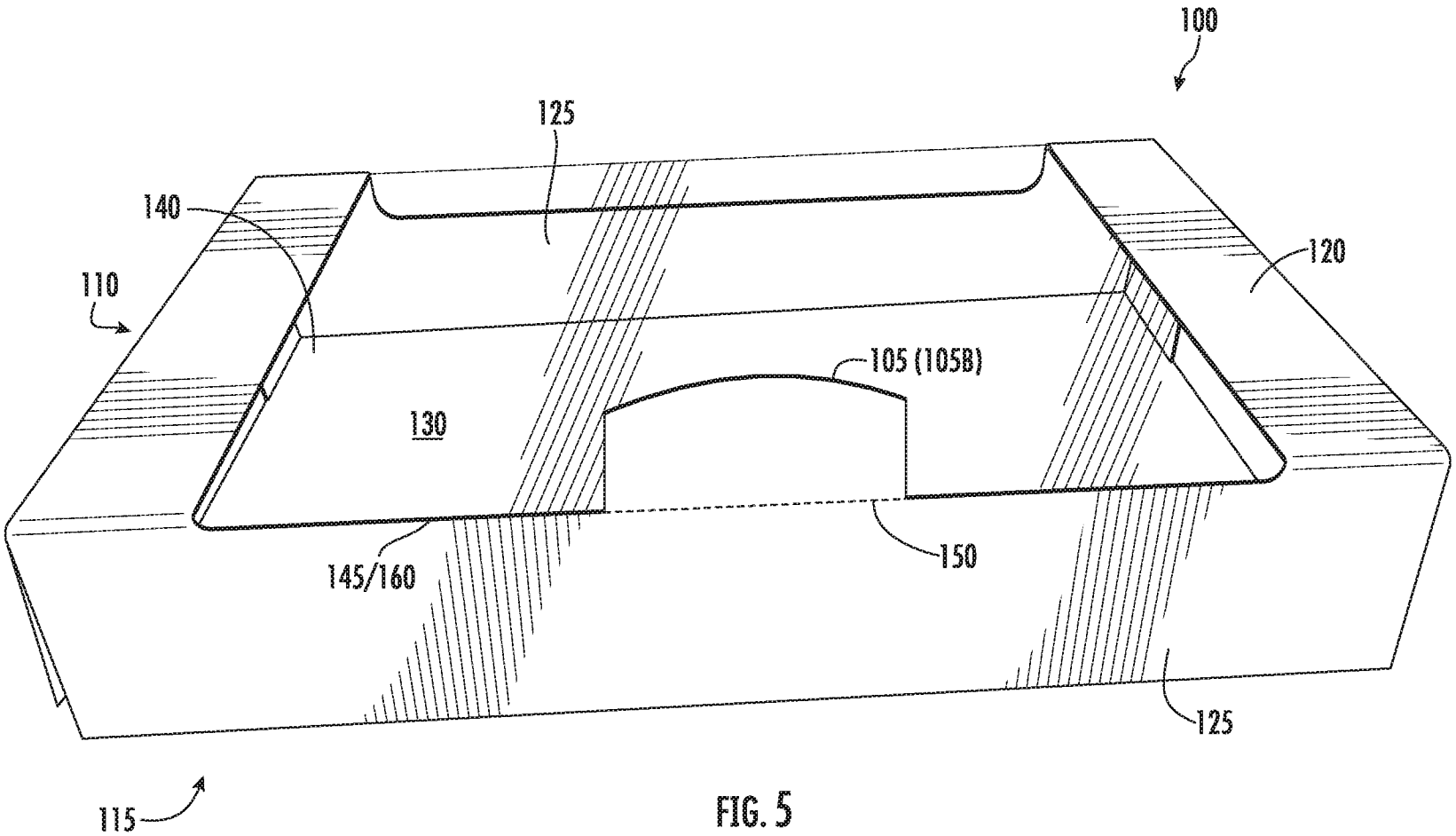
Figure 6:
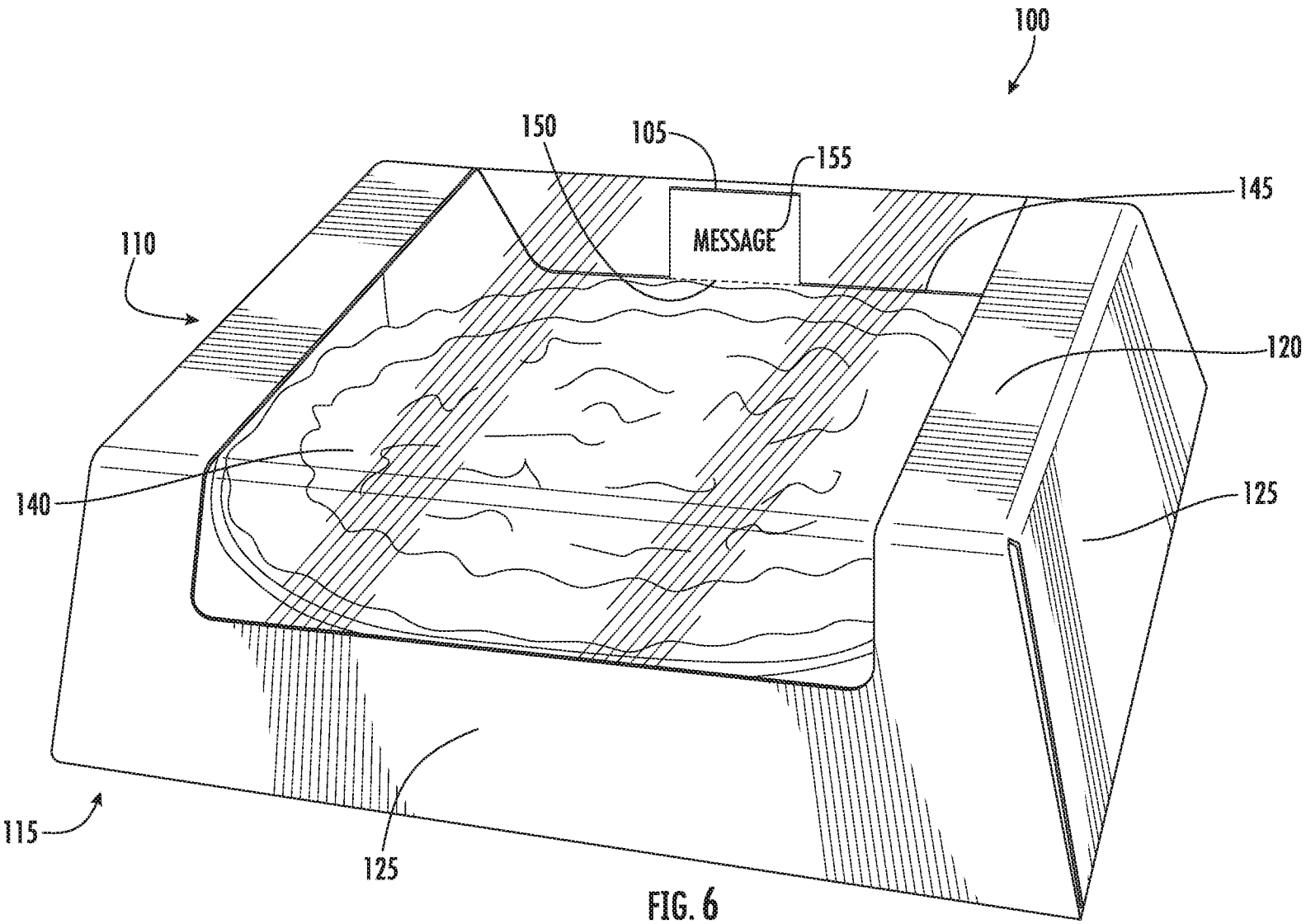
Figure 7:
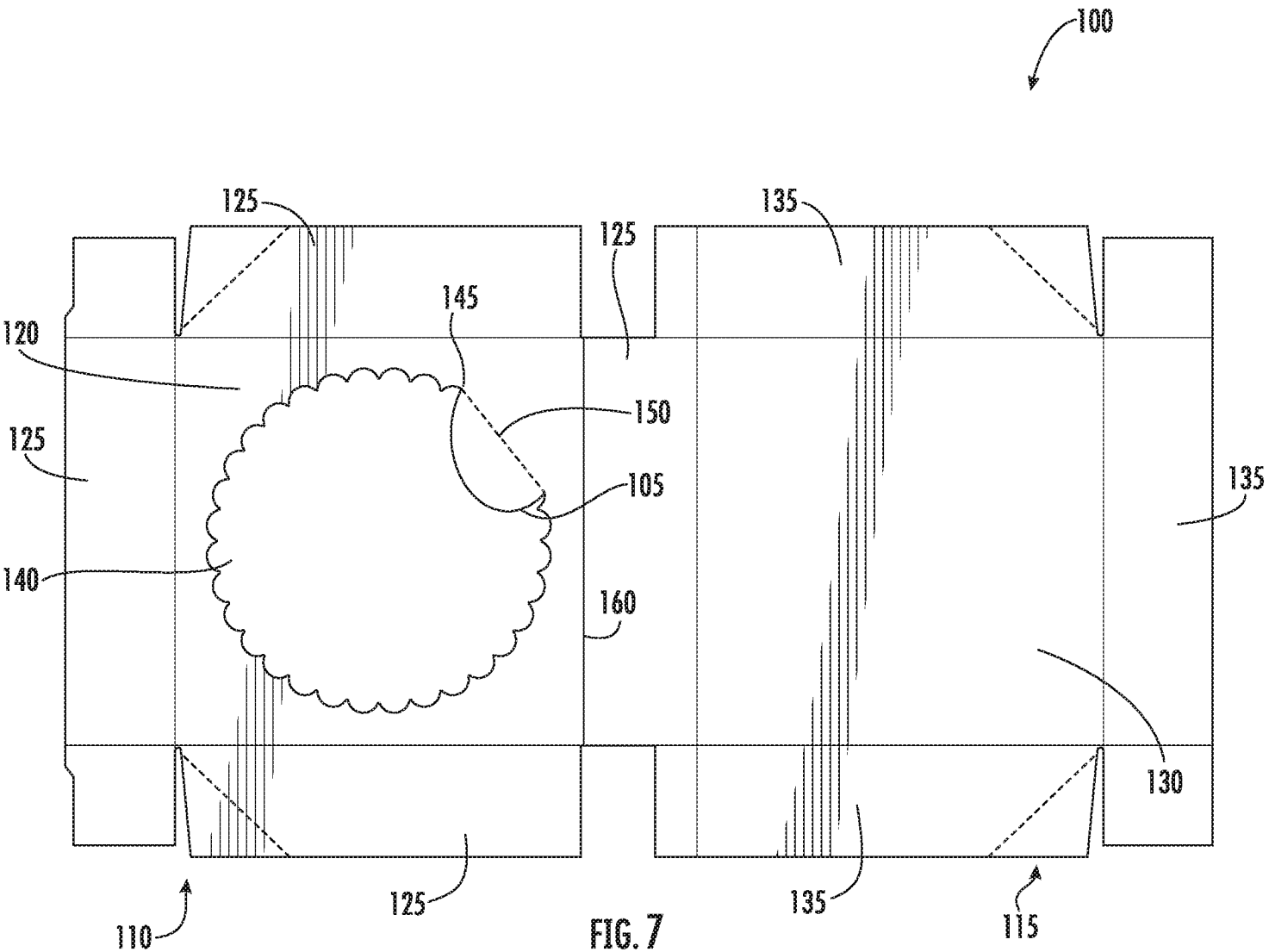
Figure 8:
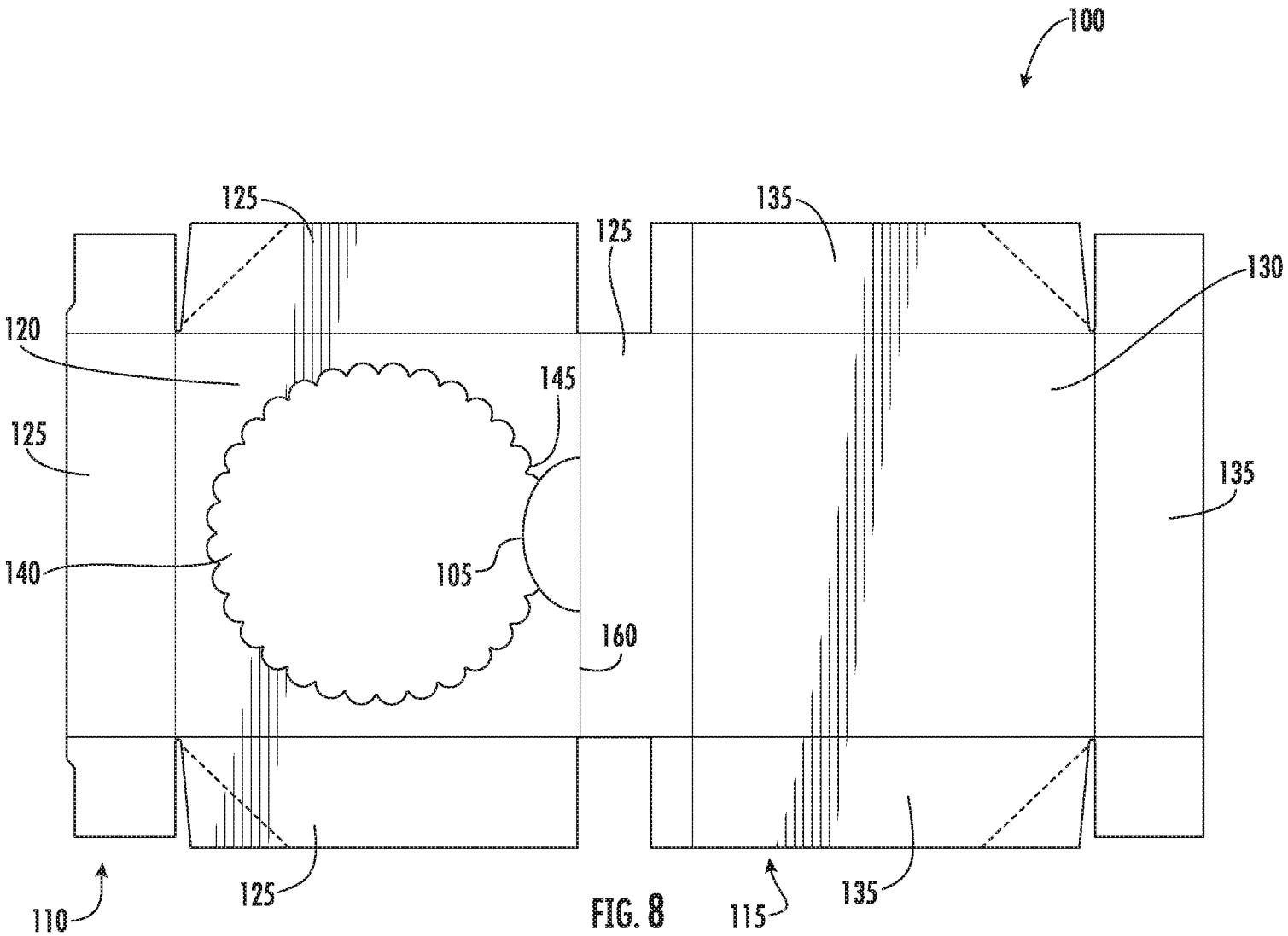
Figure 9:
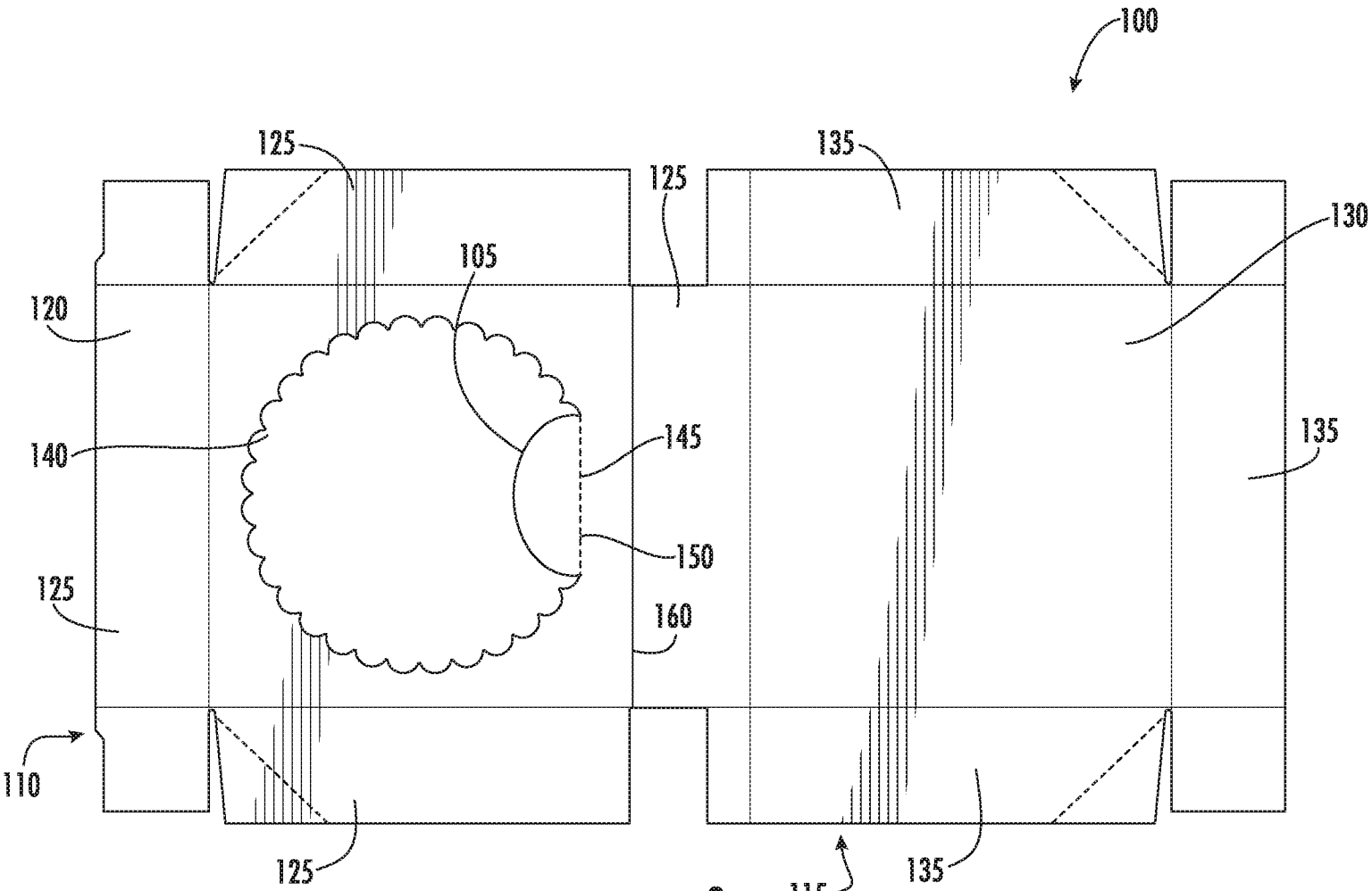

Having thus described the presently disclosed subject matter in general terms, reference will now be made to the accompanying Drawings, which are not necessarily drawn to scale, and wherein:

FIG. 1 illustrates a perspective view of a carton with tab in accordance with an embodiment of the invention;

FIG. 2 illustrates another perspective view of the carton of FIG. 1 with the tab in a folded up position; and FIG. 3 illustrates a perspective view of the carton with tab in accordance with an embodiment of the invention;

FIG. 4 illustrates a front perspective view of the carton with tab in accordance with an embodiment of the invention;

FIG. 5 illustrates a rear perspective view of the carton of FIG. 4;

FIG. 6 illustrates a front perspective view of the carton with tab in accordance with an embodiment of the invention;

FIG. 7 illustrates a plan view of a blank of the carton with tab in accordance with an embodiment of the invention;

FIG. 8 illustrates a plan view of a blank of the carton with tab in accordance with an embodiment of the invention; and FIG. 9 illustrates a plan view of a blank of the carton with tab in accordance with an embodiment of the invention.

DETAILED DESCRIPTION

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

Referring now to FIG. 1 is a perspective view of an example of the presently disclosed carton 100. Carton 100 may be a foldable style carton, and may be suitable for housing food items therein. In an unassembled/unfolded state carton 100 may be substantially flat (see for example FIGS. 7-9). Carton 100 may be shipped and stored in the unassembled/unfolded (substantially flat state) for ease and more efficient transportation and storage of carton 100 in bulk. Prior to use, carton 100 may be folded into an assembled state suitable for holding items, such as food items, including, but not limited to, pies, cakes, donuts, bread, pastries, or other food items. Foldable carton 100, in its assembled state, may be any of a number of overall general shapes including, but not limited to, square, rectangular, pyramidal, triangular, circular, oval, or any other suitable shape.

Carton 100 may include a lid portion 110 and a bottom portion 115, wherein the lid portion 110 may be hingeably connected to, or sit atop, the bottom portion 115. The lid portion 110 may include a top surface 120 and a plurality of sides 125 (e.g., front, rear, left, and right sides). Bottom portion 115 may include a floor 130 and a plurality of sides 135 (e.g., front, rear, left, and right sides). Carton 100 may be made of paperboard or other suitable material.

In one embodiment, for example where the lid portion 110 is hingeably connected to the bottom portion 115, lid portion 110 may include front, rear, left, and right sides 125; and bottom portion 115 may include front, left, and right sides 135. In this embodiment, rear side 125 may extend from a rear edge of top surface 120 of lid portion 110 to a rear edge of floor 130 of bottom portion 115, wherein the rear side 125 hingeably connects lid portion 110 and bottom portion 115. Lid Portion 110 may hinge about the interface between the rear edge of top surface 120 of lid portion 110 and the top edge of rear side 125 and/or about the interface between the rear edge of the floor 130 of the bottom portion 115 and a bottom edge of rear side 125.

In an alternate embodiment, for example where the lid portion 110 sits over (or atop) the bottom portion 115, lid portion 110 may include front, rear, left, and right sides 125 and bottom portion 115 may include front, rear, left, and right sides 135. In such an embodiment, the lid portion 110 may nestle down over, or atop, the bottom portion 115 to substantially or fully enclose the carton 100.

The carton 100 may further include a window 140 disposed at least partially in the top surface 120 of the lid portion 110. Wherein, in one embodiment, the window 140 may extend from the top surface 120 of the lid portion 110 into one or more of sides 125, for example, into one or more of front side 125 and/or rear side 125 of the lid portion 110. That is the window 140 may be disposed only within the top surface 120 of lid portion, or may be disposed within the top surface 120 of the lid portion 110 and extend into either or both of the front side 125 and/or rear side 125 of the lid portion. The window 140 may be made of a transparent or semi-transparent film, such as, but not limited to polyethylene terephthalate (PET), MYLAR, or other suitable material.

Carton 100 may further include a tab 105. Tab 105 may be of any suitable shape and size, including, but not limited to, curved, square, rectangular, triangular, or any number of other suitable shapes or combination of shapes. In one embodiment, for example as shown in FIGS. 1 and 2, the tab 105 may be disposed along an edge of a window cutout line 145, and may be configured such that the tab 105 is foldable from a first position 105A to a second position 105B. In first position 105A the tab 105 is preferably substantially parallel with and extends substantially flat relative to the top surface 120 of the lid portion 110, and may extend to overlap a portion of the window 140. In the second position 105B the tab 105 is preferably substantially perpendicular to and extends vertically upward relative to the top surface 120 of the lid 110. The interface between the tab 105 and the window cutout line 145 may include a score line or perforations 150, or may be otherwise configured to allow for ease of folding the tab between the first position 105A and second position 105B and/or optionally for removal of the tab 105 from the foldable carton 100. In one embodiment, the tab 105 may include alphabetic and/or numeric text, QR code, bar code, and/or other graphic or design printed on at least one side thereof (hereinafter referred to as "message 155"). In one non-limiting example, the message 155 printed on the tab 105 may be a message to the consumer such as, "baked fresh daily." Message 155 may be any kind of message, design, and/or information, such as, but not limited to, a product identifier, a redeemable coupon, or any other message or design. In one example, the message 155 may be printed on the side of the tab 105 facing window 140 when the tab 105 is in the first position 105A, wherein a consumer could view the message 155 through the window 140 when they open the lid portion 110 of the carton 100. Alternatively, a retailer may fold the tab 105 back to the second position 105B when the carton 100, with product therein, is merchandised in the store, thereby more readily exposing the message 155 printed thereon to a consumer. When folded back in the second position 105B, the tab 105 would become more noticeable to the consumer as it would be extending up vertically from lid portion 110 of the carton 100. The tab 105, in one embodiment, may be removable from the foldable carton 100, e.g., along a score line or perforations 150, thus in an example where the message 155 printed on tab 110 includes a redeemable coupon the consumer may remove the tab 105 to redeem it at the store.

In another embodiment, as shown in FIGS. 3-5, the tab 105 may be disposed along or proximate to an outer edge 160 of the top surface 120 of the lid portion 110, for example, along a top fold/score line, or at an edge of the window cutout line 145 of the carton 100 that is proximate to the outer edge 160. In one example, tab 105 may be configured such that when the carton 100 is in a folded (assembled) state the tab 105 pops up automatically to second position 105B extending vertically up relative to the top surface 120 of the lid portion 110. In this embodiment, when the foldable carton 100 is in an unfolded (unassembled) state the tab 105 is in first position 105A, wherein tab 105 lays parallel with and substantially flat relative to the top surface 120 of the lid portion 110, and may extend to overlap a portion of the window 140. When the foldable carton 100 is folded into its folded (assembled) state the tab 105 is configured, such that it automatically pops up to second position 105B and extends vertically up relative to the top surface 120 of the lid portion 110. In this embodiment, tab 105 may be attached along its bottom edge to carton 100 along the edge of a portion of window cutout line 145 (or outer edge 160), for example at the interface of the top edge of the rear side 125 and rear edge of the top surface 120. In such a configuration, with the tab 105 only attached at its bottom edge at the interface of the rear side 125 and top surface 120, folding the carton to an assembled state causes tab 105 to pop up to second position 105B due to folding the rear side 125 relative to the top surface 120 from a substantially flat state (e.g., about 180 degrees) to a folded state (e.g., about 90 degrees). The interface between the tab 105 and the edge of window cutout line 145 (or outer edge 160) may include a score line or perforations 150, or may be otherwise configured, to allow for ease of folding and or optionally for removal of the tab 105 from the foldable carton 100.

In another embodiment, as shown, for example, in FIG. 6, tab 105 may have one edge thereof disposed along an edge of window cutout line 145 of carton 100. In this embodiment, tab 105 may extend vertically up from the window cutout line 145 such that a top edge of the tab 105 is substantially even with the top surface 120 of the lid portion 110. In this embodiment, when the carton 100 is in its folded (assembled) state the tab 105 may be configured such that a consumer could view the message 155 through the window 140 when the lid 110 is closed, and/or when the consumer opens the lid 110. In this embodiment, the interface between the tab 105 and the window cutout line 145 may include a score line or perforations 150, or may be otherwise configured, to allow for ease of folding and/or optionally for removal of the tab 105 from the foldable carton 100.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

What is claimed is:

1. A carton comprising:

a. a lid portion;

b. a bottom portion;

c. a viewable tab attached to the lid portion, wherein the tab comprises one or more of alphabetic text, numeric text, QR code, bar code, graphic, design, or combination thereof printed on the tab; and wherein the viewable tab is configured to automatically move from a first position to a second position as a result of at least one of folding the carton to an assembled state or closing the lid portion, wherein in the second position the tab is configurable to be orientated perpendicular to a top surface of the lid portion, and wherein the viewable tab is attached to the lid portion along only a single edge of the viewable tab.

2. The carton of claim 1, wherein the lid portion is hingeably connected to the bottom portion.

3. The carton of claim 1, wherein in the first position the tab is orientated flat against the top surface of the lid portion.

4. The carton of claim 1, wherein the tab is removable from the carton.

5. The carton of claim 4, wherein the interface between the tab and where it attaches to the lid portion is weakened.

6. The carton of claim 4, wherein the interface between the tab and where it attaches to the lid portion comprises a score line or perforations.

7. The carton of claim 1, wherein the tab is attached at an interface between a top surface and a side portion of the lid portion.

8. The carton of claim 1, further comprising a window disposed in the lid portion.

9. The carton of claim 8, wherein the window is disposed in the top surface of the lid portion.

10. The carton of claim 8, wherein the window is disposed in the top surface of the lid portion and extends into one or more of a front side or a rear side of the lid portion.

11. The carton of claim 9, wherein the tab attaches to the lid portion at a peripheral edge of the window.

12. The carton of claim 10, wherein the tab attaches to the lid portion at a peripheral edge of the window that extends into one or more of the front side or the rear side of the lid portion.

13. The carton of claim 12, wherein the tab extends vertically up from its attachment point at the peripheral edge of the window to a height equal to the top surface of the lid portion.

14. A method of assembling a carton with a viewable tab, the method comprising:

a. providing a carton in an unfolded configuration, the carton comprising:
   i. a lid portion;
   ii. a bottom portion; and
   iii. a tab attached to an interface between a top surface of the lid portion and a side of the lid portion, wherein the tab is attached to the lid portion along only a single edge of the tab, and wherein the tab comprises one or more of alphabetic text, numeric text, QR code, bar code, graphic, design, or combination thereof printed on the tab; and b. folding the carton into an assembled configuration, wherein upon folding the carton into the assembled configuration the tab is configured to move from a first position to a second position, wherein in the second position the tab is orientated perpendicular to a top surface of the lid portion.

15. The method of claim 14, wherein in the first position the tab is orientated flat against the top surface of the lid portion.

16. The method of claim 14, wherein the carton further comprises a window disposed in the lid portion.

17. The method of claim 14, wherein the tab attaches at its bottom edge to the interface between a rear edge of the top surface of the lid portion and a top edge of a rear side of the lid portion.

18. The method of claim 14, wherein the tab is removable.

* * * * *